United States Patent [19]

Kennedy

[11] Patent Number: 5,036,682

[45] Date of Patent: Aug. 6, 1991

[54] JEWELRY UTILIZING CYLINDRICAL GEMSTONES

[76] Inventor: John J. Kennedy, Route 112, Huntington Rd., Worthington, Mass. 01098

[21] Appl. No.: 561,869

[22] Filed: Aug. 2, 1990

[51] Int. Cl.[5] ..... A44C 17/02

[52] U.S. Cl. ..... 63/28; 63/15; 63/26

[58] Field of Search ..... 63/15, 20, 26, 28, 32, 63/1.1, 2

[56] References Cited

U.S. PATENT DOCUMENTS

| | | | |
|---|---|---|---|
| 843,006 | 2/1907 | Dover . | |
| 1,328,948 | 1/1920 | Dover . | |
| 1,328,949 | 1/1920 | Dover . | |
| 1,421,339 | 6/1922 | Zalowitz . | |
| 1,539,940 | 6/1925 | Gaschke . | |
| 1,654,335 | 12/1927 | Lindroth . | |
| 2,261,958 | 11/1941 | Burri . | |
| 2,749,597 | 6/1956 | Fus | 63/26 X |
| 4,566,294 | 1/1986 | Brzozowski . | |
| 4,796,442 | 1/1989 | Sarcona . | |
| 4,821,533 | 4/1989 | Bonnefoy . | |

FOREIGN PATENT DOCUMENTS

| | | | |
|---|---|---|---|
| 597629 | 11/1925 | France | 63/28 |
| 43440 | 6/1934 | France | 63/15 |
| 1437648 | 3/1966 | France | 63/15 |

*Primary Examiner*—Laurie K. Cranmer

[57] ABSTRACT

An article of jewelry has a metal finding having in its surface a recess defined by a base wall, side walls and end walls. A multiplicity of cylindrical gemstones are disposed in the recess in abutting relationship along their axial dimension and they have their ends disposed closely adjacent the side walls. The metal of the finding about the side walls is disposed over the ends of the cylindrical gemstones to retain them securely in the recess. The cylindrical gemstones have a diameter of not more than 2.2 mm and a length to diameter ratio of at least 2:1.

11 Claims, 2 Drawing Sheets

JEWELRY UTILIZING CYLINDRICAL GEMSTONES

BACKGROUND OF THE INVENTION

The present invention relates to jewelry, and, more particularly, to jewelry using small novel gemstones set in metallic findings.

For many centuries, skilled artisans have been producing jewelry by setting gemstones in findings of various metals, and such gemstones have been of various configurations and sizes. As is well known, highly attractive and unique jewelry can be produced by using smaller gemstones by modifying the patterns in which they appear within the finding and by varying the sizes of the gemstones in a given finding. Although such gemstones have been cut in various shapes, generally they are faceted and highly polished in order to provide a high degree of brilliance. As a result, care must be given during the cutting and polishing operations, and frequently a significant portion of the uncut gemstone is lost during the cutting and faceting operations necessary to produce the desired facet configuration.

Although some gemstones have been cut in cylindrical form, these have been of large size (typically 8 mm by 15 mm) and usually strung on silk or chain to make bead type necklaces.

Typically, the baguettes for mounting in findings, with or without large gemstones, are small gemstones cut to the same size for mounting in a particular finding; they are all faceted and the assemblage in the item of jewelry tends to have a polygonal geometric appearance because of the polygonal configuration of the gemstones.

It is an object of the present invention to provide a novel item of jewelry utilizing small cylindrical gemstones which are mounted within a recess formed in the finding.

It is also an object to provide such a jewelry item which may be fabricated readily and in which the gemstones are firmly engaged.

Still another object is to provide a method for making jewelry items using small cylindrical gemstones which method lends itself to wide variation in the nature of the findings and the appearance of the ultimate jewelry item.

SUMMARY OF THE INVENTION

It has now been found that the foregoing and related objects may be readily attained in an article of jewelry including a metal finding having in its surface a recess defined by a base wall, side walls and end walls. A multiplicity of cylindrical gemstones are disposed in the recess in abutting relationship along their axial dimension and they have their ends disposed closely adjacent the side walls. The gemstones have a diameter of not more than 2.2 mm and a length to diameter ratio of at least 2:1, and the metal of the finding about the side walls is disposed over the ends of the cylindrical gemstones to retain them securely in the recess.

In one embodiment, the metal finding is a ring having the recess extending about a portion of its circumference. In the same or another embodiment, there may also be included in the recess at least one gemstone of non-cylindrical configuration and of substantially greater width dimension than the diameter of the cylindrical gemstones, and at least one of the cylindrical gemstones abuts it.

Preferably, the cylindrical gemstones have a diameter of not more than 1.8 mm, and desirably a length to diameter ratio of at least 2.5:1. In the preferred construction, the side walls of the recess have opposed and aligned channels therein, and the ends of the cylindrical gemstones are disposed therein so that there are lips disposed thereover to secure the gemstones on the recess.

In the method for making the jewelry, a metallic jewelry finding is formed with the recess. A multiplicity of cylindrical gemstones are placed therein in abutting relationship along their axial dimension, and their ends are disposed closely adjacent the side walls. These gemstones have a diameter of less than 3 mm and a length to diameter ratio of at least 2:1. After such placement, the cylindrical gemstones are secured in the recess.

In one embodiment of the process, the side walls of the recess are formed with opposed and aligned channels therein, and the ends of the cylindrical gemstones are inserted thereinto. In another embodiment, the side walls of the finding do not have a preformed recess, the metal of the finding about the side walls is deformed about the periphery of the ends of the gemstones to secure them in the recess.

DETAILED DESCRIPTION OF PREFERRED EMBODIMENTS OF THE INVENTION

Figure 1:
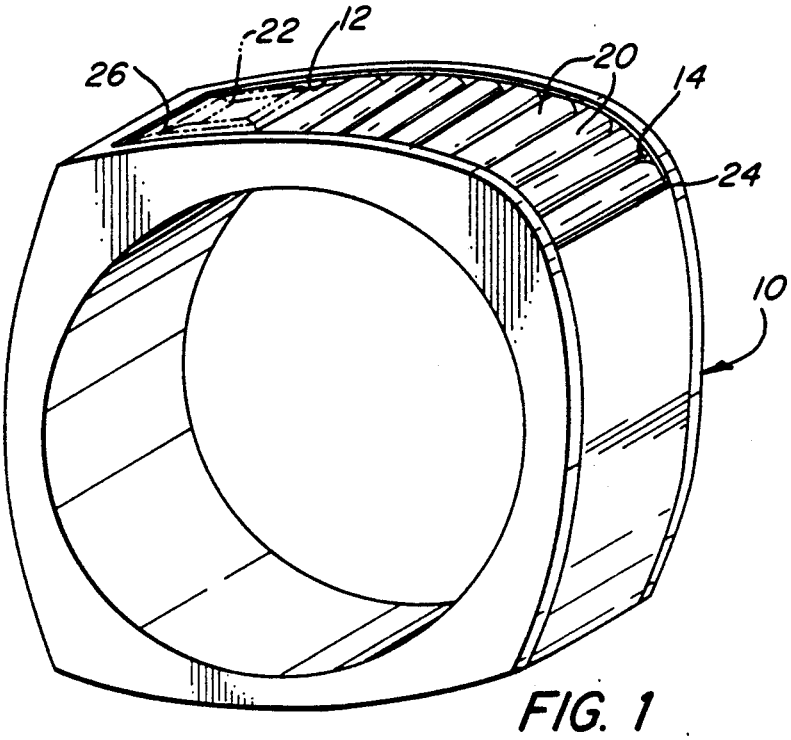
FIG. 1 is a perspective view of a ring embodying the present invention and drawn to a greatly enlarged scale.

Turning first to FIGS. 1-6, a ring embodying the present invention is illustrated therein as having a metallic finding generally designated by the numeral 10. A recess generally designated by the numeral 12 is formed in its periphery of the finding 10, and in the recess 12 are disposed a multiplicity of cylindrical gemstones 20 and, at one end, a large gemstone 22.

Figure 4:
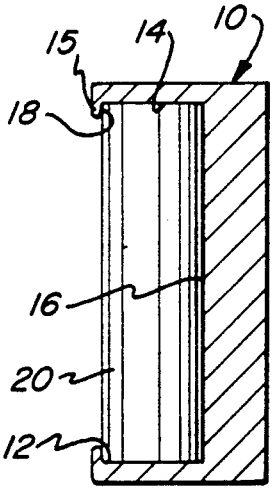
FIG. 4 is a cross sectional view thereof along the line 4—4 of FIG. 3.
Figure 2:
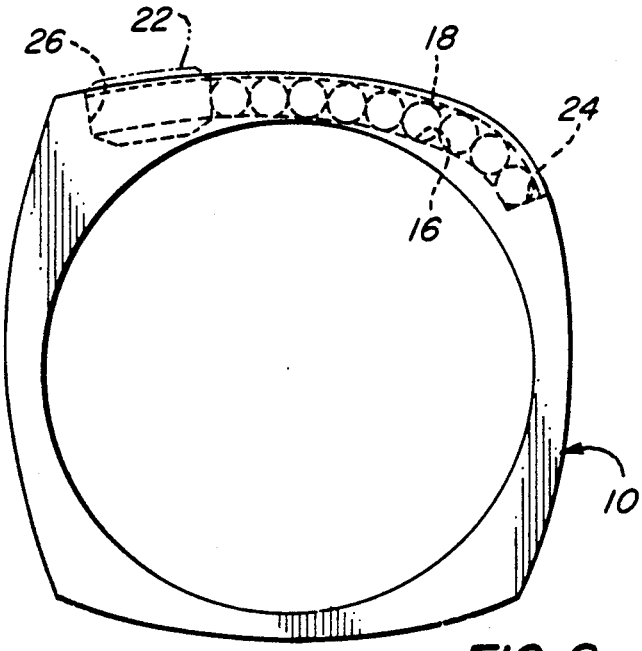
FIG. 2 is a side elevational view thereof.
Figure 5:
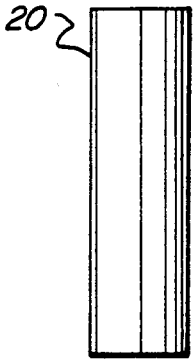
FIG. 5 is a side elevational view of one of the cylindrical gemstones therein.
Figure 3:
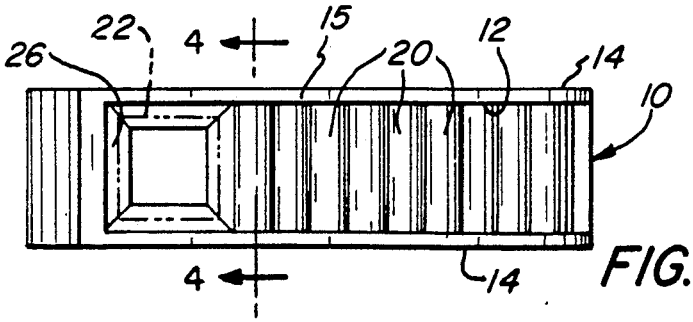
FIG. 3 is a top view thereof.
Figure 6:
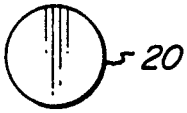
FIG. 6 is an end elevational view thereof.

As best seen in FIGS. 3 and 4, the recess 12 has a pair of side walls 14 and a base wall 16, and the overlying lips 15 on the side walls 14 define opposed channels 18 in the side walls 14. The ends of the cylindrical gemstones 20 seat in the channels 18 and are locked therein by the lips 15 which extend over their end portions. As seen in FIGS. 1-3, the cylindrical gemstones 20 abut along their axial dimension and are tightly packed to preclude any space therebetween.

In this embodiment, the large gemstone 22 is inserted into the recess 12 at its one end after the cylindrical gemstones 20 have been placed therein. The metal on the finding 10 is deformed thereabout to lock the large gemstone 22 in this position and thereby trap the cylindrical gemstones 20 in the channels 18 of the recess 12 between it and the opposite end wall 24.

Figure 7:
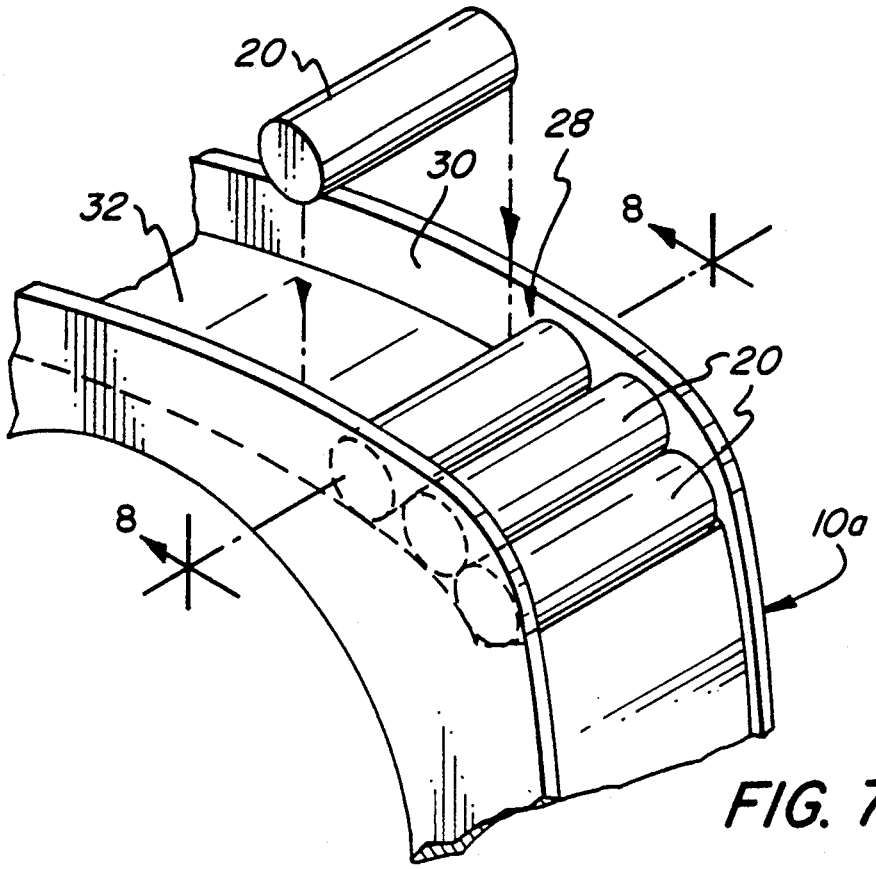
FIG. 7 is a fragmentary perspective view illustrating one embodiment of the method of the present invention during insertion of the cylindrical gemstones into the recess.
Figure 8:
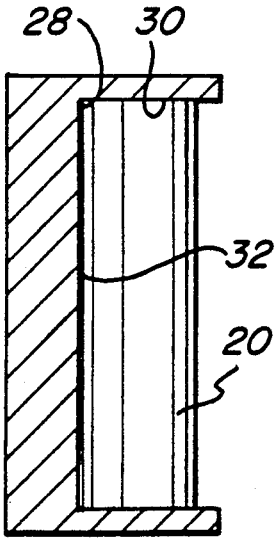
FIG. 8 is a sectional view along the line 8—8 of FIG. 7.
Figure 9:
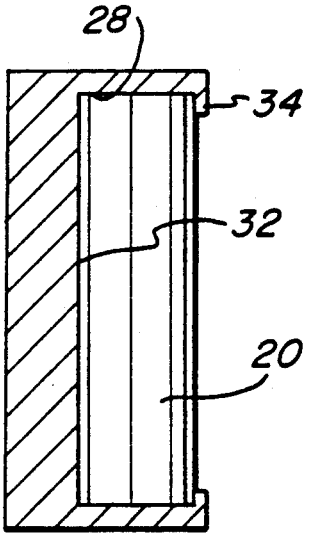
FIG. 9 is a similar view after deformation of the metal of the finding adjacent the side walls to form lips securing the ends of the gemstones in the recess.

An alternate structure for the finding is shown in FIG. 7. Here, the finding 10*a* has a groove generally designated by the numeral 28 with vertical side walls 30 and a base wall 32. After the cylindrical gemstones 20 are inserted thereinto as seen in FIG. 8, the metal at the top of the side walls 30 is deformed to provide the lips 34 as seen in FIG. 9, and the lips 34 firmly trap the cylindrical gemstones 20 within the groove 28.

The preferred structure of the finding is illustrated in FIGS. 1–6 wherein the opposed side walls are each formed with a groove or channel, either as cast or preferably by subsequent milling or machining. Although the metal of the finding may be deformed about the ends of the gemstones as indicated in the embodiment of FIGS. 7–9, it is frequently difficult to control the deformation and to obtain a clean uniform edge of metal over the ends of the cylindrical gemstones. Thus, the channels provide a capturing construction which enables a clean controlled edge along the sides.

The finding may be cast or forged with the desired recess formed therein, or the recess may be cut into a casting or forging of the appropriate shape by use of a burr or other tool. After the general contour of the recess has been formed, a second tool may be utilized to cut precisely the channels in the two side walls to receive the ends of the gemstones. As will be appreciated, the depth and height of the channels should be closely controlled to ensure a relatively tight fit of the gemstones therewithin.

The cylindrical gemstones are then inserted into the recess and into the channels, most conveniently by orienting them at an angle so that one end is first introduced into one channel and then the other end is pivoted and pushed into the opposite channel. As will be appreciated, the first gemstone will abut an end wall or other structure at the end of the recess. The process of inserting the cylindrical gemstones continues until the required number of gemstones have been inserted. At this point, a large gemstone may be utilized to close the end of the recess, and the metal of the finding may be deformed thereabout to seat it securely. Alternatively, the metal of the finding a adjacent the end of the recess may be deformed in order to provide an end wall configuration which will retain the multiplicity of cylindrical gemstones tightly within the recess.

Although not necessary, adhesives and solder may be utilized to increase the security of the gemstones within the recess.

The small cylindrical gemstones may have a diameter of up to 2.2 mm and, preferably, the diameter is within the range of 1.5–1.8 mm. The length should be at least twice the diameter, and preferably at least 2.5 times the diameter in order to provide the desired appearance. The gemstones are conveniently produced by using a hollow core drill of the desired internal diameter, and, after extracting from the core of the drill, the cylindrical gemstones are highly polished by conventional techniques.

Various types of stones may be employed including amethyst, tourmaline, garnet, citrine, aquamarine, ruby, sapphire, and the like, all of which can be utilized to produce such cylindrical shapes, by use of drills of appropriate hardness.

As will be appreciated, different gemstones may be used in the given recess to provide multiple colors or variations within the grouping. Moreover, a single finding may have more than one recess containing such gemstones, and the gemstones in one recess may be oriented at an angle to the gemstones in another recess in the same finding. Thus, the jewelry designer is given substantial opportunity and flexibility for producing jewelry items of a unique appearance. In any of the designs of the present invention employing the cylindrical gemstones, it will be appreciated that the small cylindrical shape is one yielding a soft appearance to the jewelry item in contrast with the hard geometric appearance generated by use of conventional baguettes.

Thus, it can be seen from the foregoing detailed specification and attached drawings that the jewelry of the present invention utilizes small cylindrical gemstones which are securely mounted within a recess formed in the finding. The jewelry may be fabricated and assembled in a relatively simple manner, and the unique gemstones of the present invention may be provided by core drilling or the like.

Having thus described the invention, what is claimed is:

1. An article of jewelry including:

(a) a metal finding having in its surface a recess defined by a base wall, side walls and end walls; and (b) a multiplicity of elongated cylindrical gemstones in said recess in abutting relationship along their length and having their ends disposed closely adjacent said side walls, said gemstones having a diameter of not more than 2.2 mm and a length to diameter ratio of at least 2:1, said finding having the metal about the side walls disposed over said ends of said cylindrical gemstones to retain them securely in said recess.

2. The article of jewelry in accordance with claim 1 wherein said metal finding is a ring having said recess extending about a portion of its circumference.

3. The article of jewelry in accordance with claim 1 wherein there is also included in said recess at least one gemstone of non-cylindrical configuration of substantially greater width dimension than the diameter of said cylindrical gemstones, and against which at least one of said cylindrical gemstones abuts.

4. The article of jewelry in accordance with claim 1 wherein said cylindrical gemstones have a diameter of not more than 1.8 mm and a length to diameter ratio of at least 2.5:1.

5. The article of jewelry in accordance with claim 1 wherein said side walls of said recess have opposed and aligned channels therein and the ends of said cylindrical gemstones are disposed therein so that there are lips disposed thereover to secure said gemstones therein.

6. A method for making jewelry comprising:

(a) forming a metallic jewelry finding with a recess in its surface, said recess being defined by a base wall, side walls and end walls;

(b) inserting into said recess a multiplicity of elongated cylindrical gemstones in abutting relationship along their length and having their ends disposed closely adjacent said side walls, said gemstones having a diameter of not more than 2.2 mm and a length to diameter ratio of at least 2:1; and (c) securing said cylindrical gemstones in said recess.

7. The method for making jewelry in accordance with claim 6 wherein said metal finding is a ring having said recess extending about a portion of its circumference.

8. The method for making jewelry in accordance with claim 6 wherein there is included the step of inserting into said recess a gemstone of non-cylindrical configuration of substantially greater width dimension than the diameter of said cylindrical gemstones.

9. The method for making jewelry in accordance with claim 6 wherein said cylindrical gemstones have a diameter of not more than 1.8 mm and length to diameter ratio of at least 2.5:1.

10. The method for making jewelry in accordance with claim 6 wherein said side walls of said recess are formed with opposed and aligned channels therein and the ends of said cylindrical gemstones are inserted thereinto.

11. The method for making jewelry in accordance with claim 6 wherein the metal of said finding about said side walls is deformed about the periphery of the ends of said gemstones to secure them in said recess.

* * * * *